US007031036B2

(12) United States Patent
Chao

(10) Patent No.: US 7,031,036 B2
(45) Date of Patent: Apr. 18, 2006

(54) BRACING APPARATUS

(75) Inventor: Min Chao, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 283 days.

(21) Appl. No.: 10/756,369

(22) Filed: Jan. 14, 2004

(65) Prior Publication Data

US 2005/0152105 A1 Jul. 14, 2005

(51) Int. Cl.
*H04N 1/04* (2006.01)

(52) U.S. Cl. ..... 358/497; 248/118; 369/112.01; 361/725; 399/380

(58) Field of Classification Search ..... 369/112.01; 248/200; 347/118, 108; 358/497; 361/679–687, 361/724–727; 399/380
See application file for complete search history.

(56) References Cited

U.S. PATENT DOCUMENTS 6,442,896 B1 * 9/2002 Chapin, III ..... 49/193
6,678,077 B1 * 1/2004 Huang ..... 358/497
6,739,713 B1 * 5/2004 Jones et al. ..... 347/88
6,851,802 B1 * 2/2005 Sakakibara et al. ..... 347/108

* cited by examiner

*Primary Examiner*—Hung Van Duong
(74) *Attorney, Agent, or Firm*—Birch, Stewart, Kolasch & Birch, LLP

(57) ABSTRACT

A bracing apparatus adopted for bracing an upper casing, pivotally engaged with a lower casing with electronic elements inside, of hatch-top electronic devices facilitate repairs and maintenance of the electronic elements in the lower casing. The bracing apparatus includes a first and a second linkage bar and an elastic element. The first linkage bar is remote from the pivotal joint of the upper and the lower casing, connects to the upper casing and pivotally connects to the second linkage bar. The second linkage bar connects to the lower casing. The pivotal connection end of the first and the second linkage bars is directing outwards from the neighboring sides of the upper casing and the lower casing. The elastic element connects to the upper casing abutting the pivotal joint of the upper casing and the lower casing, and the pivotal connection end of the first and the second linkage bars.

2 Claims, 8 Drawing Sheets

BRACING APPARATUS

FIELD OF THE INVENTION

The invention relates to a bracing apparatus adopted for use on hatch-top electronic devices.

BACKGROUND OF THE INVENTION

Nowadays business machines (such as copiers, facsimile machines, printers, scanners, and the like) have become indispensable information equipment in office environments. They not only can enhance working quality and efficiency, but also make storing and management of files and records more convenient and tidy. However, because the machines are designed and made by different vendors, their operation is also different. As each machine requires a space for installation, allocating space to accommodate those machines in a limited office environment is a big problem for users. With the advance of technologies and increasing user demands, integrating multiple functions has become a prevailing direction in the design of information products these days. The goal is to integrate multiple functions in a single multi-function peripheral (MFP) to reduce space usage in the working environment and increase working efficiency.

Referring to FIGS. 1, 2 and 3 for the structure of a conventional MPF, the invention combines the functions of copying, scanning and printing. It includes a document feeding dock 11, document holding dock 12, upper lid 13, paper feeding tray 14, paper holding rack 15, operation panel 16, and scanning zone 17. When in use, the original documents are placed on the document feeding dock 11. Operation is controlled through the operation panel 16. The machine automatically fetches documents from the document feeding dock 11 to perform copying operation. When the copying operation is finished, the machine automatically discharges the documents to the document holding dock 12. The paper feeding tray 14 holds blank papers, while the copies of the original documents are conveyed and held on the paper holding rack 15. The scanning zone 17 includes a transparent board (such as glass). There is a scanner module chamber 20 located under the scanning zone that includes a scanning module 19. For scanning, users place the original document on the scanning zone 17. The scanning module 19 scans the original document. The captured optical signals of the image are converted to corresponding electric signals for transferring to a computer to display or store.

In the interior of the MFP, there is a cartridge replacing compartment for housing an inkjet cartridge (or inkjet head) 21. When the inkjet cartridge (or inkjet head) 21 is depleted, users have to turn the upper casing of the MFP about the axle 18 to replace the inkjet cartridge (or inkjet head) 21. After the replacement is finished, the upper casing is turned about the axle 18 for closing to make the MFP returning to the original condition. Then the entire replenishment process is completed. During the replacement operation users have to lift and brace the upper casing of the MFP. It is obvious that convenience for the replacement operation set forth above is not desirable.

In order to improve the convenience of replacement of the inkjet cartridge, another design has been developed as shown in FIG. 4. It has a spring 32, abutting the axle 18, and a hook 31 on a remote end of the upper casing of the MFP. The upper casing of the MFP can latch on the lower casing through the hook 31. When the hook is released, the spring 32 can brace the upper casing of the MFP.

SUMMARY OF THE INVENTION

The primary object of the invention is to provide a bracing apparatus adopted for use on hatch-top electronic devices, that provides a sufficient force to support the upper casing of the electronic devices in a steady manner, when electronic elements in the lower casing of the electronic devices are being replaced. Thereby, the invention improves replacement convenience and prevents the upper casing from incidental closing during replacement operations, to avoid hurting user's hands.

The bracing apparatus according to the invention is adopted for use on hatch-top electronic devices. The electronic devices include an upper casing and a lower casing that contain electronic elements. When the upper casing is pivotally turned relative to the lower casing, the bracing apparatus can support the upper casing. The bracing apparatus includes first linkage bars, second linkage bars and elastic elements. Each first linkage bar has a connection end and a pivot end. The connection end connects to the upper casing, and is remote from the pivotal joint of the upper casing and the lower casing. The second linkage bar has a connection end and a pivot end. The connection end connects to the lower casing at a location corresponding to where the first linkage bar connects to the upper casing. The pivot end of the second linkage bar connects to the pivot end of the first linkage bar. The pivot ends of the first linkage bar and the second linkage bar directly outwards from the neighboring sides of the upper casing and the low casing. The elastic element has a first coupling end and a second coupling end. The first coupling end connects to the upper casing abutting the pivotal joint of the upper casing and the lower casing. The second coupling end connects to the pivot ends of the first linkage bar and the second linkage bar.

Thus when the upper casing is gradually opened and pivotally turned relative to the lower casing, the angle between the first linkage bar and the second linkage bar increases gradually until there is an adequate arm of force formed among the first linkage bar, the second linkage bar and elastic element such that the pause elastic force of the elastic element is sufficient to withstand the gravity of the upper casing, thereby can brace and support the upper casing of the electronic device. Therefore, the upper casing does not close under its own weight, and the electronic elements in the lower casing may be replaced as desired. The invention provides an adequate force to firmly support the upper casing of the electronic device. Hence replacement operation is more convenient. In addition, incidental closing of the upper casing during replacement operation may be prevented to avoid hurting user's hands.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
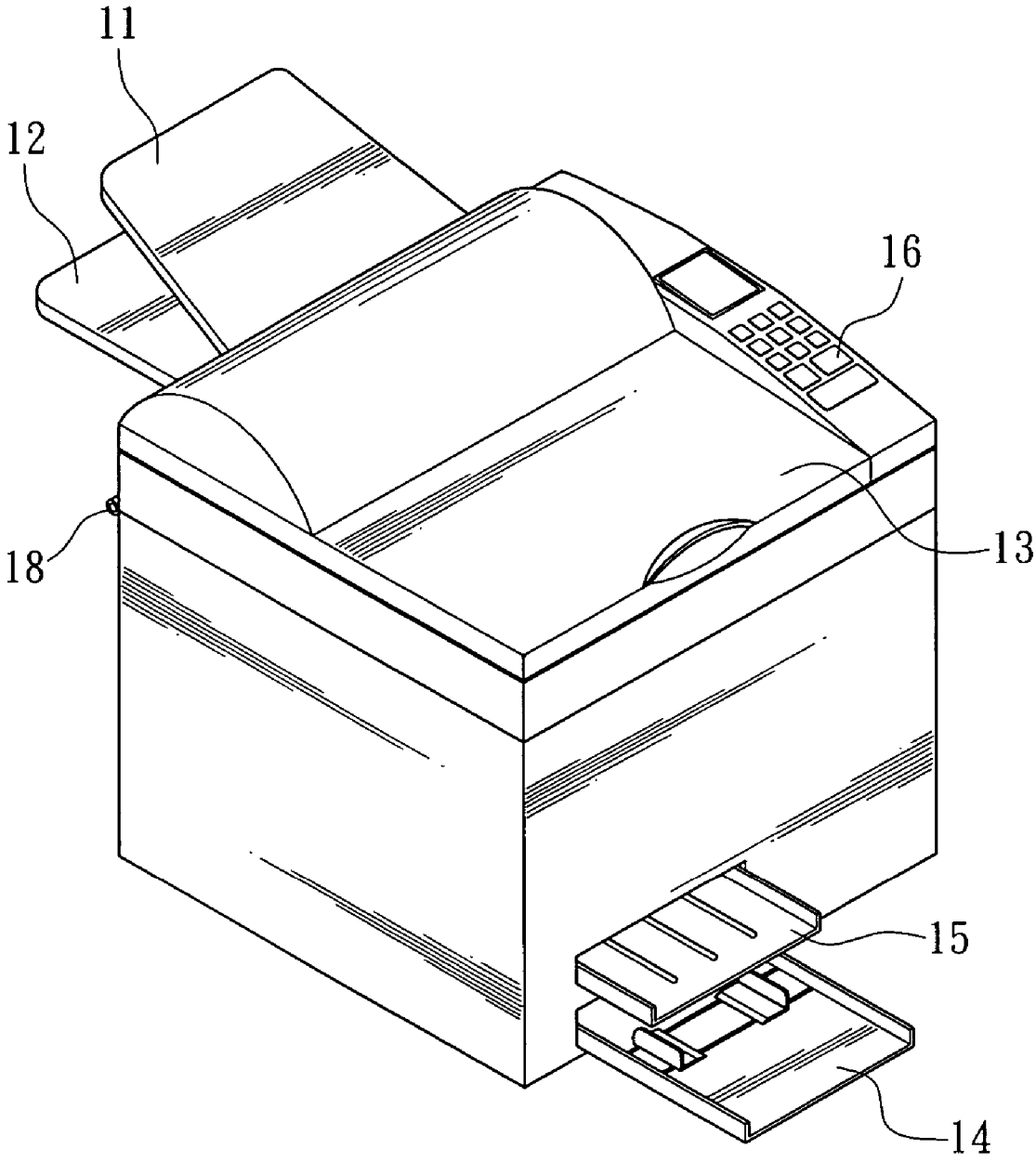
FIG. 1 (PRIOR ART)
FIG. 1 is a schematic view of a conventional technique.
Figure 2:
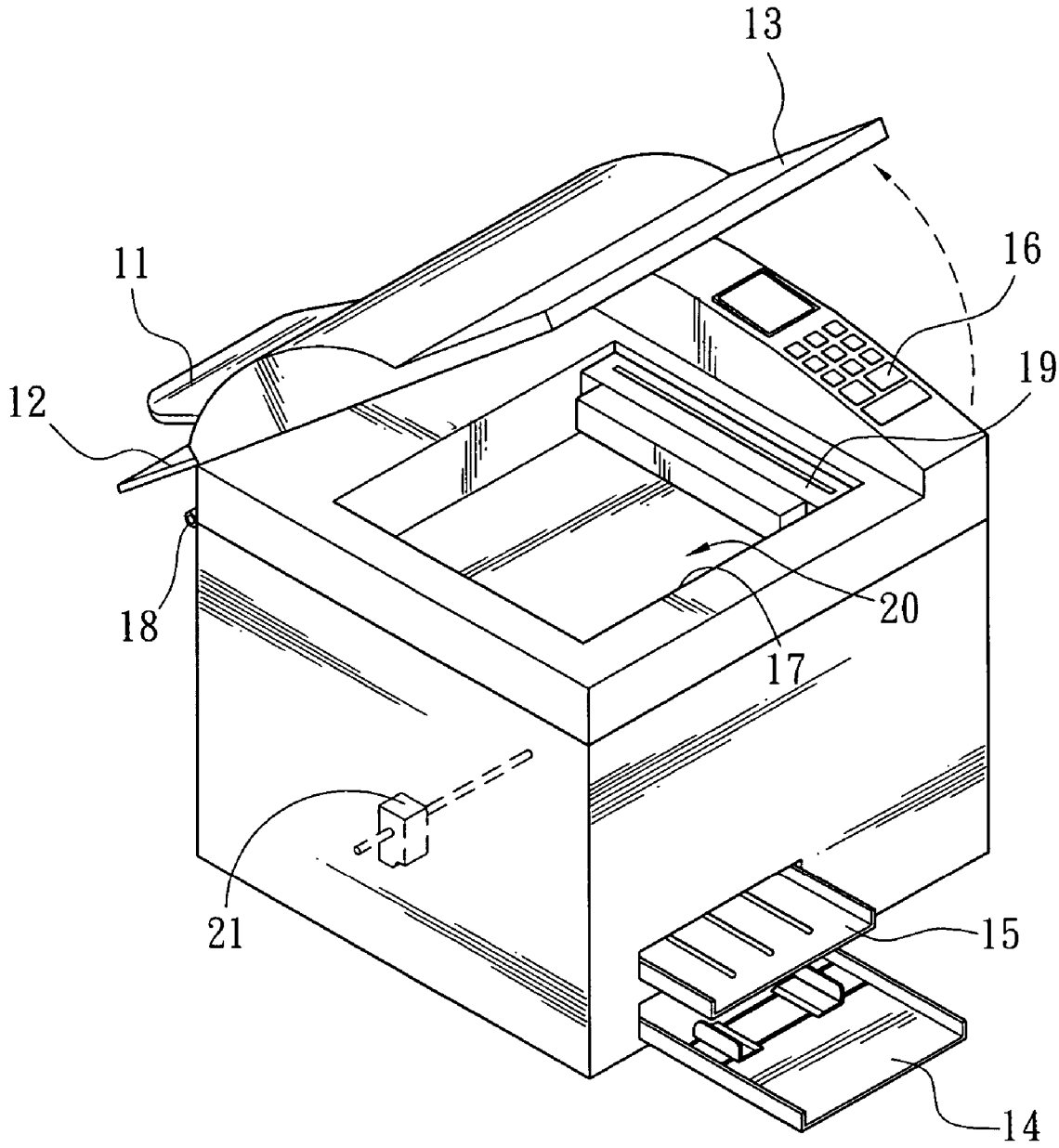
FIG. 2 (PRIOR ART)
FIG. 2 is a schematic view according to FIG. 1 with the upper lid opened.
Figure 3:
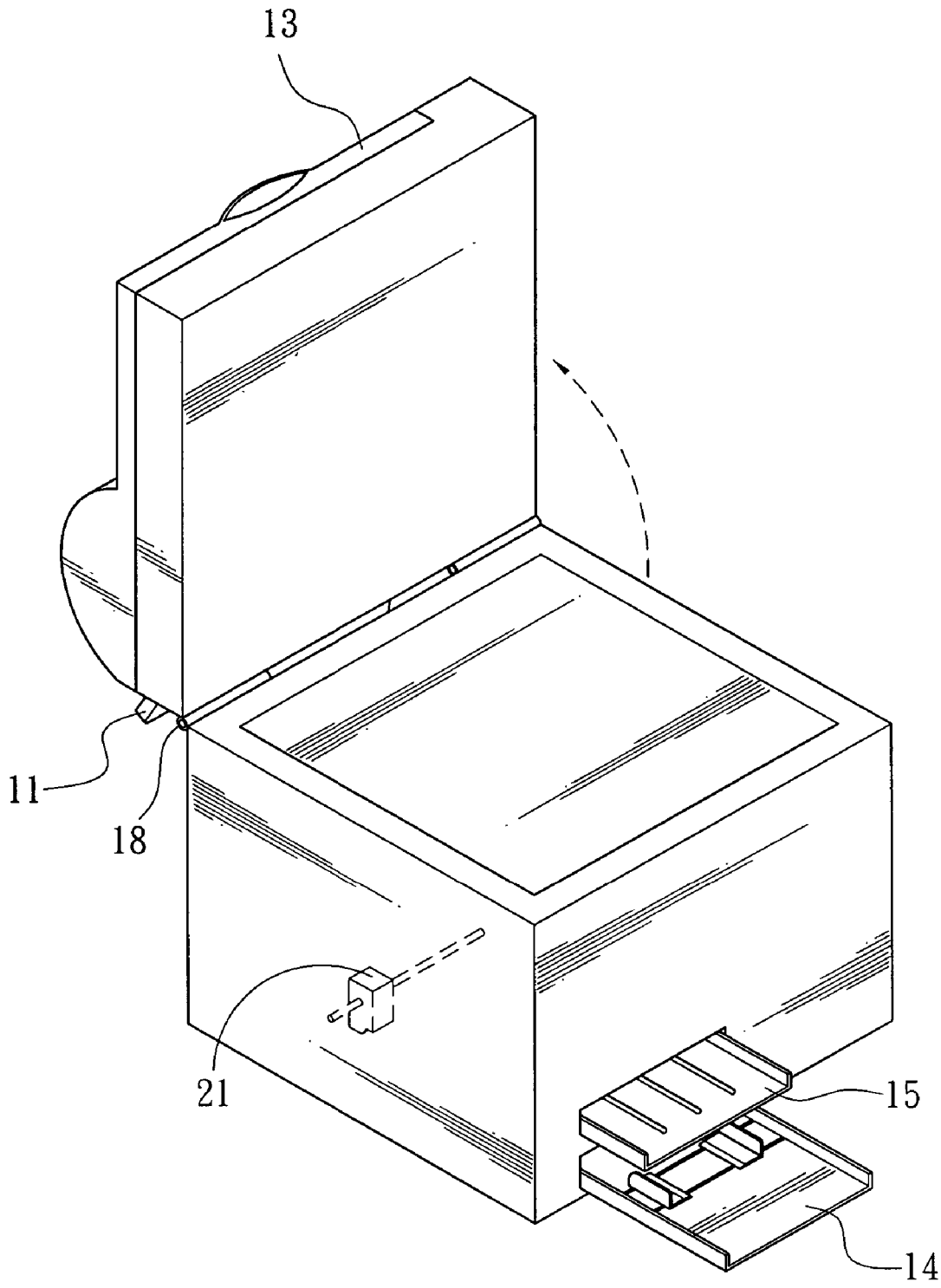
FIG. 3 (PRIOR ART)
FIG. 3 is a schematic view according to FIG. 1 with the upper casing opened.
Figure 4:
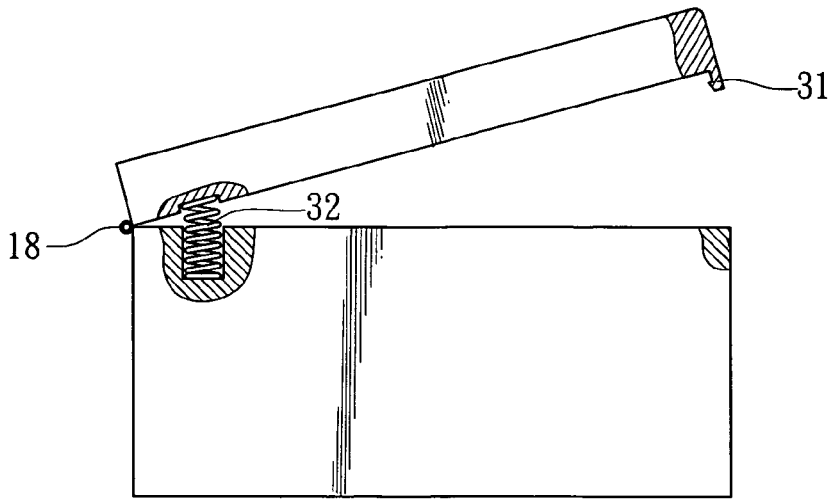
FIG. 4 (PRIOR ART)
FIG. 4 is a schematic view of another conventional technique.
Figure 5:
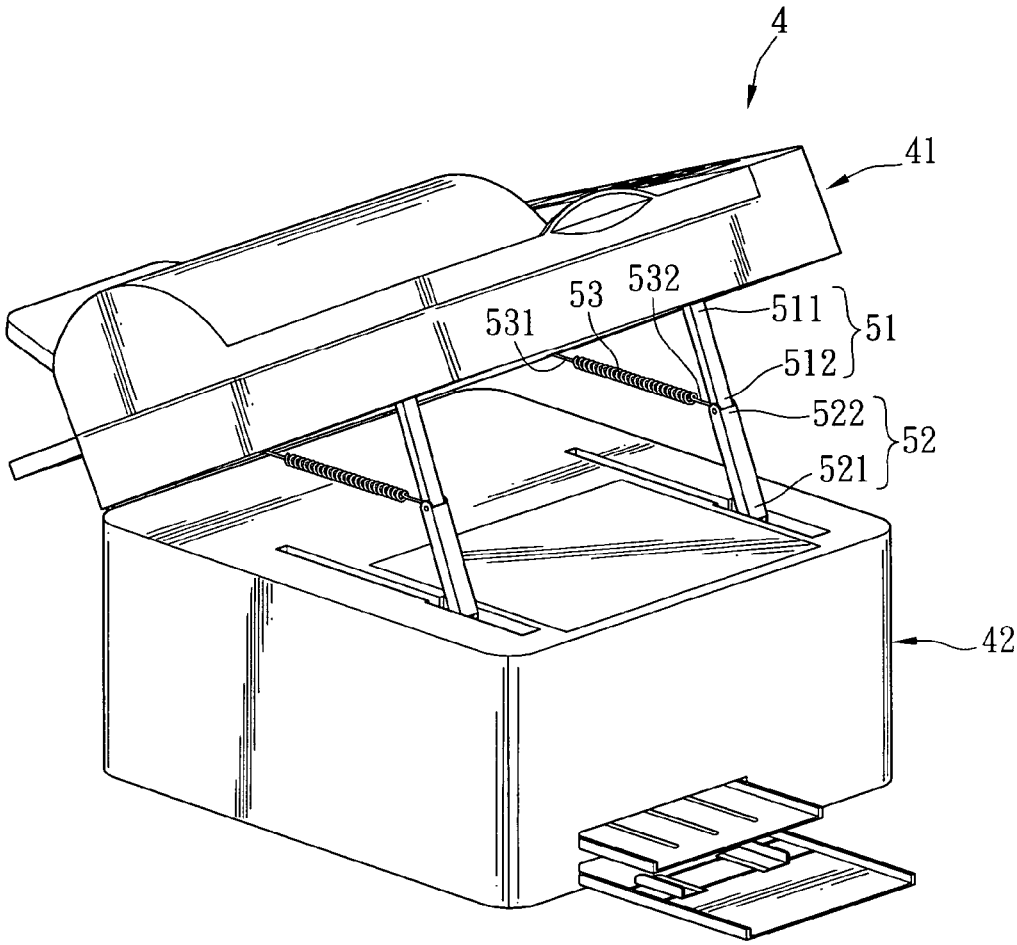
FIG. 5 is a schematic view of the invention for bracing an upper casing of a MFP.

Referring to FIG. 5, the bracing apparatus of the invention is adopted for use on hatch-top electronic devices. A MFP 4 is used as an example for the description below. The MFP 4 includes an upper casing 41 and a lower casing 42 that are pivotally engaged with each other and contain electronic elements therein. Hence after the upper casing 41 is pivotally turned relative to the lower casing 42, the invention can support the upper casing 41 and prevent the upper casing from incidental closing and avoid hurting user's hands.

The bracing apparatus of the invention includes first linkage bars 51, second linkage bars 52 and elastic elements 53. Each first linkage bar 51 has a first connection end 511 connecting to the upper casing 41, remote from the pivotal joint of the upper casing 41 and the lower casing 42. The second linkage bar 52 has a second connection end 521, connecting to the lower casing 42, at a location corresponding to where the first linkage bar 51 connects to the upper casing 41. The second linkage bar 52 has a second pivot end 522, pivotally engaged with a first pivot end 512 of the first linkage bar 51. The first pivot end 512 of the first linkage bar 51 and the second pivot end 522 of the second linkage bar 52 directly outwards from the neighboring sides of the upper casing 41 and the low casing 42. The elastic element 53 is a tension spring, and has a first coupling end 531 connecting to the upper casing 41 and abutting the pivotal joint of the upper casing 41 and the lower casing 42. Further, the elastic element has a second coupling end, 532 connecting to the first pivot end 512 of the first linkage bar 51 and the second pivot end 522 of the second linkage bar 52.

Figure 6:
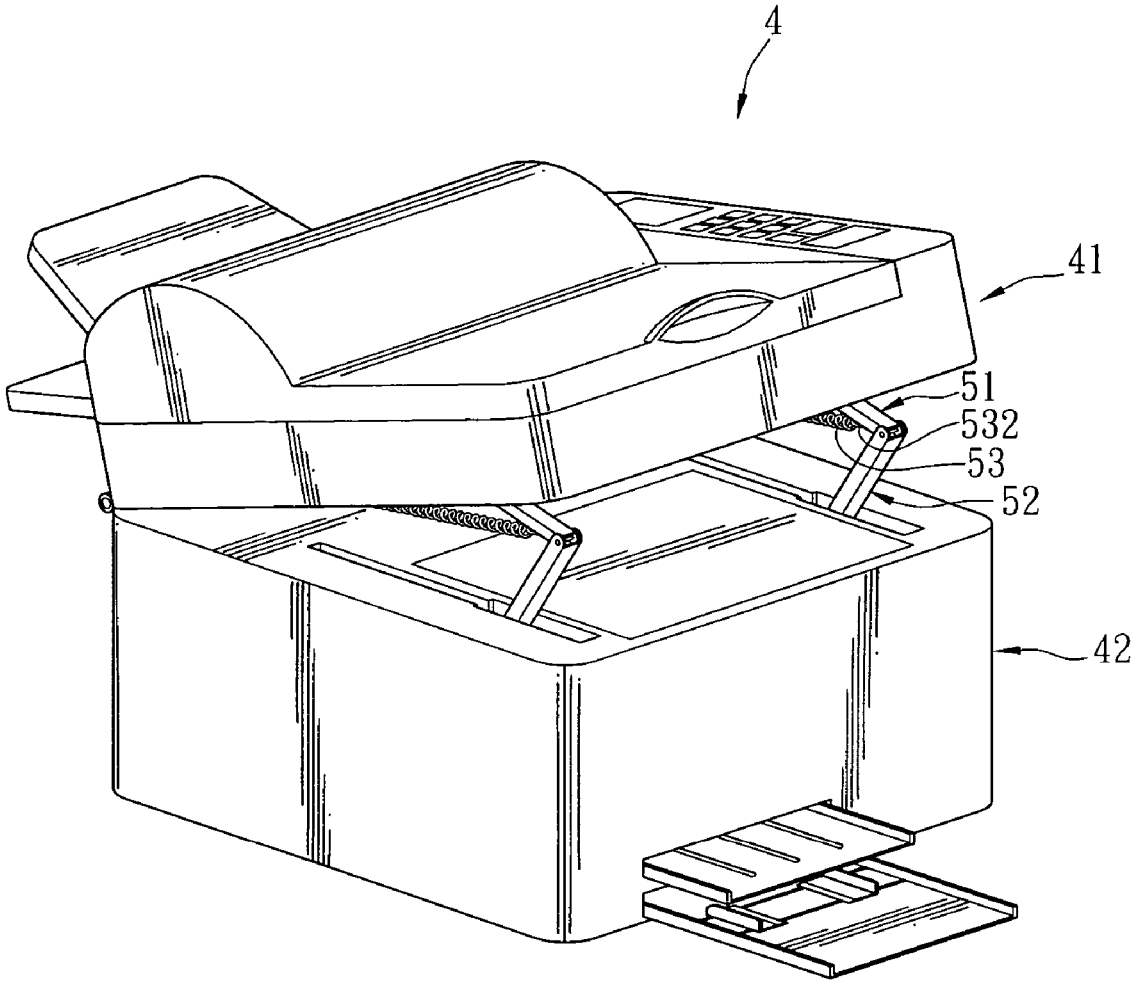
FIG. 6 is a perspective view of the invention for bracing an upper casing of a MFP.
Figure 7:
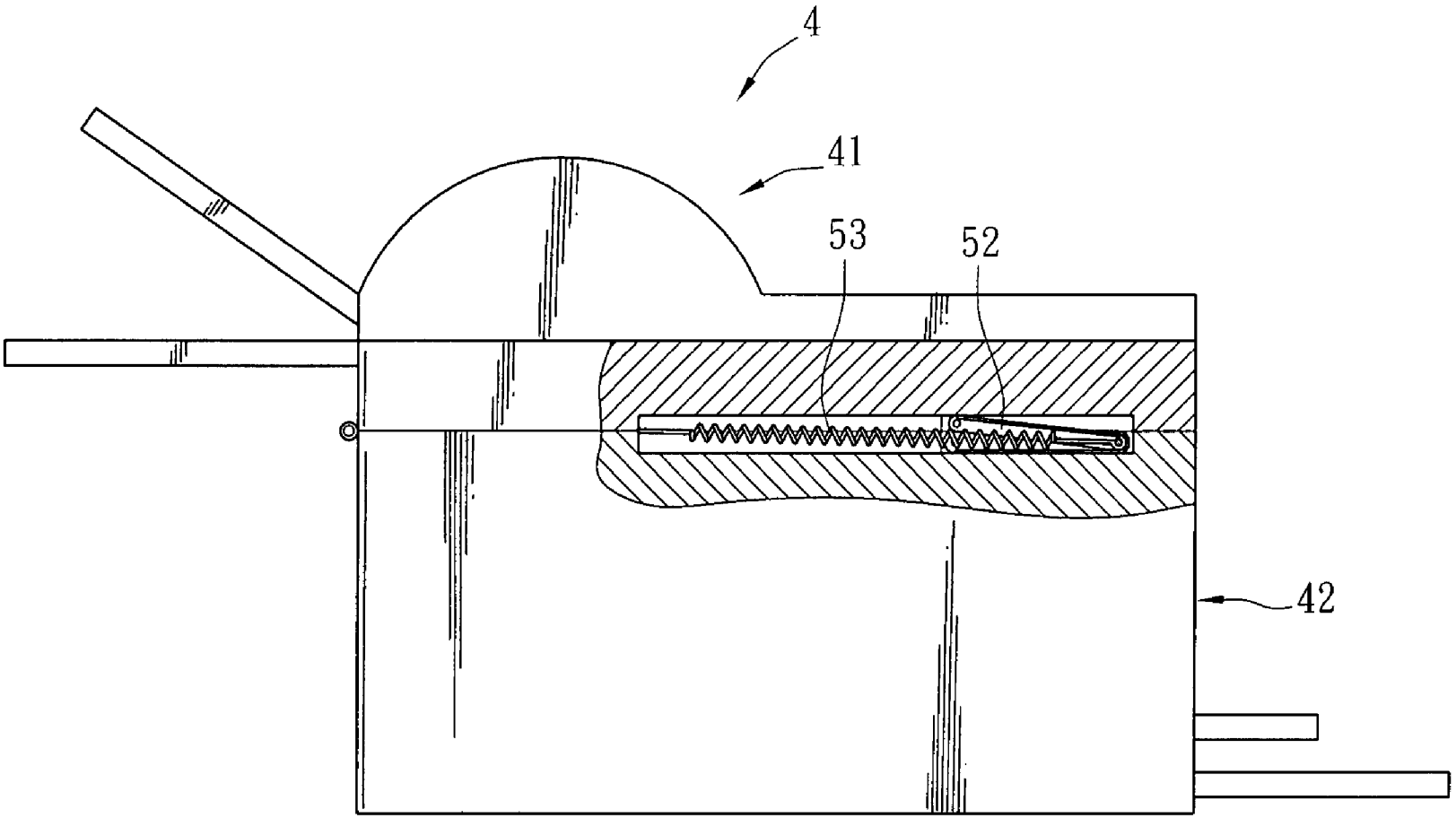
FIG. 7 is a schematic view of the invention with the upper casing of a MFP not being braced.

Referring to FIGS. 5, 6 and 7, when the upper casing 41 is gradually opened and pivotally turned relative to the lower casing 42, the angle between the first linkage bar 51 and the second linkage bar 52 increases gradually until there is an adequate arm of force formed among the first linkage bar 51, second linkage bar 52 and elastic element 53 such that the pause elastic force of the elastic element 53 is sufficient to withstand the gravity of the upper casing 41 of the electronic device 4. Like this, it braces and supports the upper casing 41 of the electronic device 4. Therefore, the upper casing 41 does not close under its own weight. When the inkjet cartridge is being replaced, the invention provides an adequate force to firmly support the upper casing 41 of the electronic device 4. Hence replacing of the inkjet cartridge is more convenient. In addition, incidental closing of the MFP 4 during inkjet cartridge replacement may be prevented to avoid hurting user's hands.

On the other hand, when the upper casing 41 is gradually closed and pivotally turned relative to the lower casing 42, the angle between the first linkage bar 51 and the second linkage bar 52 gradually decreases until the first linkage bar 51 and the elastic element 53 (or the second linkage bar 52 and the elastic element 53) are almost parallel with each other. Thus the upper casing 41 of the MFP 4 may close under its own weight.

Figure 8:
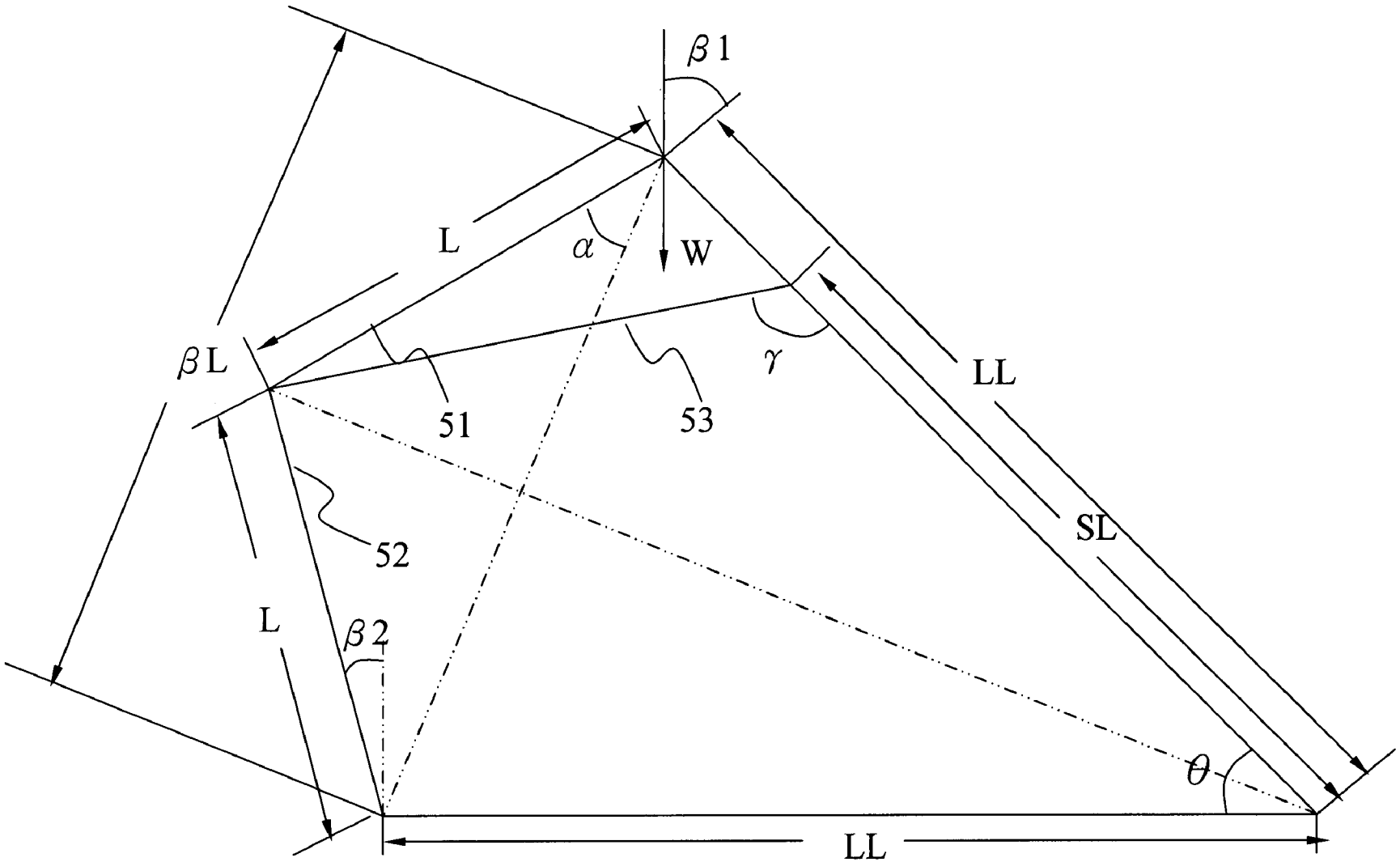
FIG. 8 is a geometric chart showing the elastic element connecting to the upper casing.

Referring to FIG. 8, calculation of where the elastic element 53 has to be connected to the upper casing 41 can be accomplished as follows:

Definitions:

L:the length of the first linkage bar 51, and the second linkage bar 52, LL:the difference between the pivotal joint of the upper casing 41 and the lower casing 42 and the first connection end 511 of the first linkage bar 51. Further, the difference between the pivotal joint of the upper casing 41 and the lower casing 42 and the second connection end 521 of the second linkage bar 52, θ:the included angle between the upper casing 41 and the lower casing 42, W:the weight of the MFP 4, βL:the distance between the first connection end 511 of the first linkage bar 51 and the second connection end 521 of the second linkage bar 52, β1:the included angle between the direction of the weight W and the first linkage bar 51, β2:the included angle between the direction of the weight W and the second linkage bar 52, α:the angle between the straight line formed between the first connection end 511 of the first linkage bar 51 and the second connection end 521 of the second linkage bar 52 and the first linkage bar 51, γ:the included angle between the elastic element 53 and the upper casing 41, SL:the difference between the pivotal joint of the upper casing 41 and the lower casing 42 and the first coupling end 531 of the elastic element 53.

The calculation equations are as follows:

$$\beta L=2*LL*\sin(\theta/2)$$

$$\alpha=\cos^{-1}(\beta L/2L)$$

$$\beta 1=\alpha+(\theta/2)$$

$$\beta 2=\alpha-(\theta/2)$$

$$\gamma=\tan^{-1}\{[SL\sin(\theta)-L\cos(\theta 2)]/[L\sin(\beta 2)+LL-SL\cos(\theta)]\}$$

The length of the elastic element 53=[LLsin(β2)+LL−SLcos(θ)]/cos(γ)

The elastic force of the elastic element 53=W[tan(β1)+tan(θ2)]/cos(γ)

Figure 9:
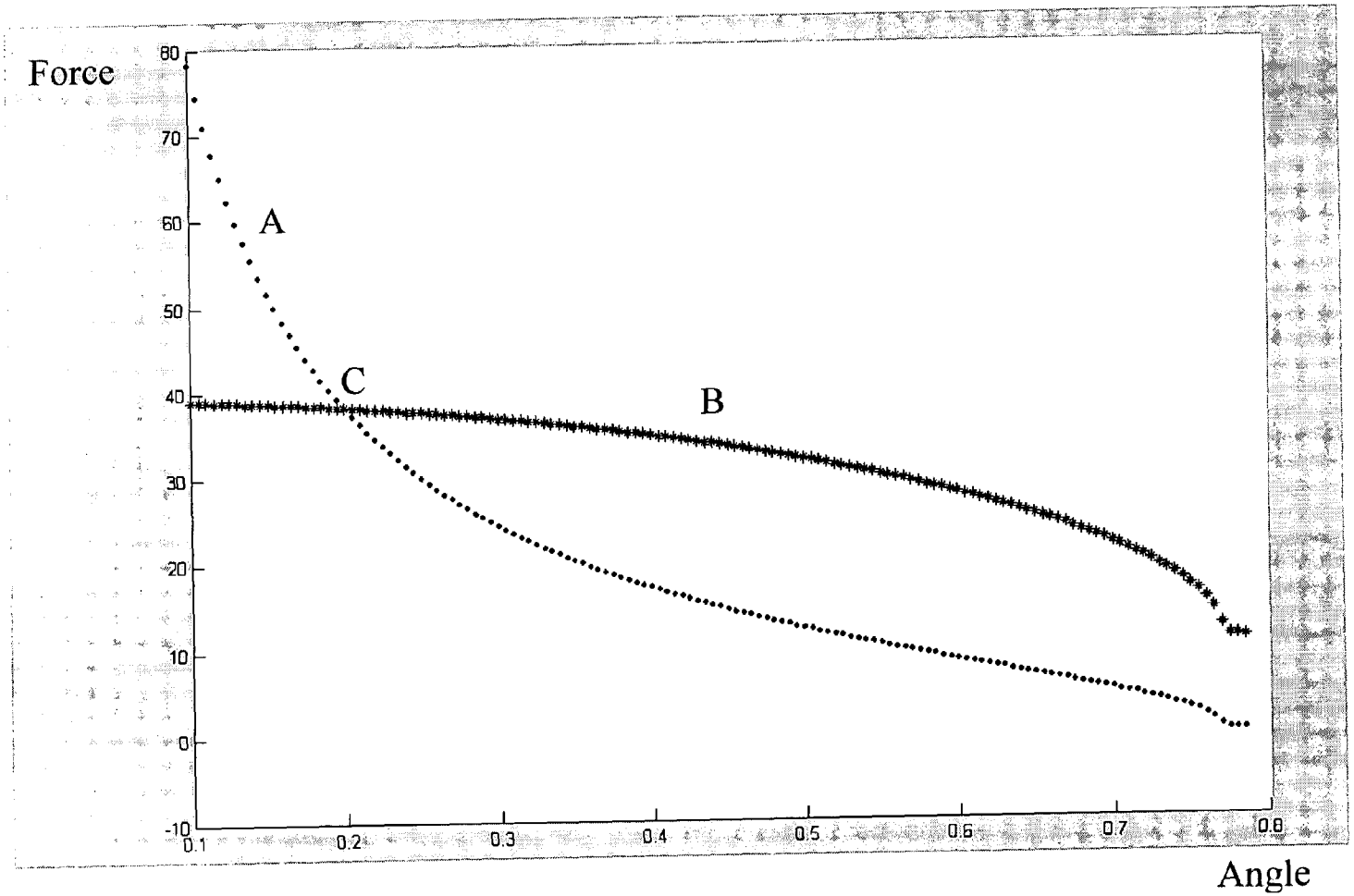
FIG. 9 is a chart showing the curves and relationship between the opening angle of the upper casing and the elastic force of the elastic element.

Cause the second coupling end 532 of the elastic element 53 connects to the first pivot end 512 and the second pivot end 522, the position that the elastic element 53 connecting to the 41 can be calculated by the calculation equation of the length of the elastic element 53. And the elastic force of the elastic element 53 also can be calculated by the calculation equations. Based on the calculations set forth above, a chart for the relationship between the opening angle of the upper casing 41 and the elastic force of the elastic element 53 can be obtained as shown in FIG. 9. Here, A is the curve of the elastic element 53 that can keep the upper casing 41 of the MFP 4 from closing, B is the characteristic curve of the elastic element 53, and C is the cross point of A and B that also is the balanced point. Thus in the elastic zone of A where the required elastic force is smaller than where B is located, the elastic element 53 can brace and support the upper casing 41 of MFP 4.

While the preferred embodiment of the invention has been set forth for the purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. A bracing apparatus for bracing an upper casing, pivotally engaged with a lower casing with electronic elements inside, of hatch-top electronic, comprising:

a first linkage bar which has a first connection end and a first pivot end, the first connection end connecting to the upper casing and being remote from the pivotal connection end of the upper casing and the lower casing;

a second linkage bar which has a second connection end and a second pivot end, the second connection end connecting to the lower casing at a location corresponding to where the first linkage bar connects to the upper casing, the second pivot end connecting to the first pivot end of the first linkage bar, the first pivot end of the first linkage bar and the second pivot end of the second linkage bar directing outwards from neighboring sides of the upper casing and the low casing; and an elastic element which has a first coupling end connecting to the upper casing and abutting the pivotal connection end of the upper casing and the lower casing, and a second coupling end connecting to the first pivot end of the first linkage bar and the second pivot end of the second linkage bar;

wherein the upper casing pivotally turned relative to the lower casing is braced by the bracing apparatus.

2. The bracing apparatus of claim 1, wherein the elastic element is a tension spring.

* * * * *